US006110076A

United States Patent [19]

Hurt

[11] Patent Number: 6,110,076

[45] **Date of Patent: *Aug. 29, 2000**

[54] FOLD-UP EXERCISE TREADMILL AND METHOD

[75] Inventor: C. Rodger Hurt, Jonesboro, Ark.

[73] Assignee: Spirit Manufacturing, Inc., Jonesboro, Ark.

[ * ] Notice: This patent is subject to a terminal disclaimer.

[21] Appl. No.: 09/047,183

[22] Filed: Mar. 24, 1998

Related U.S. Application Data

[63] Continuation of application No. 08/719,956, Sep. 24, 1996, Pat. No. 5,833,577.

[51] Int. Cl.[7] ..... A63B 22/02

[52] U.S. Cl. ..... 482/54; 482/51

[58] Field of Search ..... 482/51, 54

[56] References Cited

U.S. PATENT DOCUMENTS

| | | |
|---|---|---|
| D. 207,541 | 5/1967 | Hesen . |
| D. 211,801 | 7/1968 | Quinton . |
| D. 217,173 | 4/1970 | Frasier . |

(List continued on next page.)

FOREIGN PATENT DOCUMENTS

| | | |
|---|---|---|
| 2527-457-A | 2/1983 | France . |
| 2677-257-A1 | 11/1992 | France . |
| 83466 | 8/1908 | Germany . |
| 56-150562 | 4/1980 | Japan . |
| 1169148 | 10/1969 | United Kingdom . |
| 1 326 263 | 8/1973 | United Kingdom . |
| 2 120 560 | 12/1983 | United Kingdom . |

OTHER PUBLICATIONS

Spirit Treadmill SR881/SR715, Spirit Fitness Products brochure, copyright 1991.
Spirit Treadmill CT300, Spirit Fitness Products brochure, copyright 1990.
Spirit Treadmill ST 190 Series, Spirit Fitness Products brochure, copyright 1991.
The Remarkable Treadmill Conditioner, *The New Yorker, March 6, 1989, page 69.*
Pro–Form Space Saver 785XT advertisement, Rev. 1/10/96.
Pro–Form Space Saver 725XT advertisement, Rev. 1/10/96.
Pro–Form Space Saver 525si advertisment, Rev. 8/6/96.
Pro–Form Space Saver 725si advertisement, Rev. 8/1/96.
Cross Walk csi Space Saver advertisement, copyright 1996.
Pro–Form Cross Walk advertisement, Rev. 1/10/96.
Weslo Cadence CT25 Space Saver advertisement, 1996.
Weslo Cadence 920 Space Saver advertisement, 1996.
Weslo Cadence 845 Space Saver advertisement, 1996.
Weslo Cadence CT10 Space Saver advertisement, 1996.
Weslo Cadence CT25 Space Saver advertisement, 1996.
Pro–Form 580si *User's Manual*, Sears, Roebuck and Co., Hoffman Estates, IL 60179.

(List continued on next page.)

*Primary Examiner*—Glenn E. Richman
*Attorney, Agent, or Firm*—Crutsinger & Booth

[57] ABSTRACT

A fold-up treadmill apparatus for in-place walking, jogging, and running exercise is provided. The treadmill apparatus includes a base assembly and a treadmill assembly. The treadmill assembly has a forward end and a rearward end. According to the presently most preferred embodiment, the forward portion of the treadmill assembly is pivotally mounted to the base assembly and the rearward end is free. The treadmill assembly includes a means for raising and lowering the forward end of the treadmill assembly, whereby the incline of the treadmill assembly can be adjusted between about zero degrees to the horizontal and about fifteen degrees to the horizontal when the rearward end of the treadmill assembly is supported on a floor. The rearward end of the treadmill assembly can also be pivotally rotated upward and about the pivotal connection to the base assembly, whereby the treadmill assembly can be moved between a substantially horizontal position for use during an exercise session and a substantially vertical position for temporary storage.

36 Claims, 6 Drawing Sheets

U.S. PATENT DOCUMENTS

| | | |
|---|---|---|
| D. 270,555 | 9/1983 | Ogden . |
| D. 283,239 | 4/1986 | Smith et al. . |
| D. 284,597 | 7/1986 | Smith et al. . |
| D. 289,312 | 4/1987 | Trulaske et al. . |
| D. 303,556 | 9/1989 | Trulaske et al. . |
| 321,388 | 6/1885 | Ruebsam . |
| 663,486 | 12/1900 | Boren . |
| 881,521 | 3/1908 | Wilson . |
| 931,394 | 8/1909 | Day . |
| 1,020,777 | 3/1912 | Peterson . |
| 1,082,940 | 12/1913 | Flora . |
| 1,715,870 | 6/1929 | Spain . |
| 1,850,530 | 3/1932 | Brown . |
| 1,902,694 | 3/1933 | Edwards . |
| 1,928,089 | 9/1933 | Blickman . |
| 1,973,945 | 9/1934 | Chavin et al. . |
| 2,117,957 | 5/1938 | Heller . |
| 2,855,200 | 10/1958 | Blickman . |
| 2,874,971 | 2/1959 | Devery . |
| 3,047,291 | 7/1962 | Hall . |
| 3,127,171 | 3/1964 | Noland et al. . |
| 3,378,259 | 4/1968 | Kupchinski . |
| 3,586,322 | 6/1971 | Kverneland . |
| 3,589,715 | 6/1971 | Mark et al. . |
| 3,592,466 | 7/1971 | Parsons . |
| 3,614,097 | 10/1971 | Blickman . |
| 3,642,279 | 2/1972 | Cutter . |
| 3,650,529 | 3/1972 | Salm et al. . |
| 3,659,845 | 5/1972 | Quinton . |
| 3,689,066 | 9/1972 | Hagen . |
| 3,731,917 | 5/1973 | Townsend . |
| 3,738,649 | 6/1973 | Miller . |
| 3,741,538 | 6/1973 | Lewis et al. . |
| 3,751,033 | 8/1973 | Rosenthal . |
| 3,826,491 | 7/1974 | Elder . |
| 3,858,938 | 1/1975 | Krestensson et al. . |
| 3,874,657 | 4/1975 | Niefojewski . |
| 3,892,404 | 7/1975 | Martucci . |
| 3,918,710 | 11/1975 | Niebojewski . |
| 3,963,101 | 6/1976 | Stadelmann et al. . |
| 3,966,182 | 6/1976 | Stadelmann et al. . |
| 4,026,545 | 5/1977 | Schonenberger . |
| 4,066,257 | 1/1978 | Moller . |
| 4,112,928 | 9/1978 | Putsch . |
| 4,248,476 | 2/1981 | Phelps . |
| 4,300,761 | 11/1981 | Howard . |
| 4,350,336 | 9/1982 | Hanford . |
| 4,383,714 | 5/1983 | Ishida . |
| 4,406,451 | 9/1983 | Gaetano . |
| 4,422,635 | 12/1983 | Herod et al. . |
| 4,423,864 | 1/1984 | Wilk . |
| 4,496,147 | 1/1985 | DeCloux et al. . |
| 4,553,231 | 11/1985 | d'Alayer de Costemore d' Arc . |
| 4,625,962 | 12/1986 | Street . |
| 4,664,646 | 5/1987 | Rorabaugh . |
| 4,679,787 | 7/1987 | Gailbault . |
| 4,757,987 | 7/1988 | Allemand . |
| 4,805,901 | 2/1989 | Kulick . |
| 4,826,153 | 5/1989 | Schalip . |
| 4,886,266 | 12/1989 | Trulaske . |
| 4,905,330 | 3/1990 | Jacobs . |
| 4,913,396 | 4/1990 | Dalebout et al. . |
| 4,913,423 | 4/1990 | Farran et al. . |
| 4,921,247 | 5/1990 | Sterling . |
| 4,974,831 | 12/1990 | Dunham . |
| 4,998,725 | 3/1991 | Watterson . |
| 5,002,271 | 3/1991 | Gonzales . |
| 5,029,801 | 7/1991 | Dalebout et al. . |
| 5,058,881 | 10/1991 | Measom . |
| 5,102,380 | 4/1992 | Jacobson et al. . |
| 5,109,778 | 5/1992 | Berkowitz et al. . |
| 5,110,117 | 5/1992 | Fisher et al. . |
| 5,163,885 | 11/1992 | Wanzer et al. . |
| 5,184,988 | 2/1993 | Dunham . |
| 5,192,255 | 3/1993 | Dalebout et al. . |
| 5,207,622 | 5/1993 | Wilkinson et al. . |
| 5,207,628 | 5/1993 | Graham . |
| 5,282,776 | 2/1994 | Dalebout . |
| 5,299,992 | 4/1994 | Wilkinson . |
| 5,352,167 | 10/1994 | Ulicny . |
| 5,372,559 | 12/1994 | Dalebout et al. . |
| 5,382,207 | 1/1995 | Skowronski et al. . |
| 5,441,467 | 8/1995 | Stevens . |
| 5,662,557 | 9/1997 | Watterson . |
| 5,669,857 | 9/1997 | Watterson . |
| 5,672,140 | 9/1997 | Watterson . |
| 5,674,156 | 10/1997 | Watterson . |
| 5,674,453 | 10/1997 | Watterson . |
| 5,676,624 | 10/1997 | Watterson . |
| 5,683,332 | 11/1997 | Watterson . |
| 5,733,228 | 3/1998 | Stevens . |
| 5,772,560 | 6/1998 | Watterson et al. . |

OTHER PUBLICATIONS

Pro–Form 725xt *User's Manual*, Sears, Roebuck and Co., Hoffman Estates, IL 60179.

Space Maker 1000$^{198}$LS *User's Manual*, Sears, Roebuck and Co., Hoffman Estates, IL 60179.

Copy of brochure entitled "Technology for Total Fitness Genesis 1000", 6 pages –copyright 1985.

Copy of brochure entitled "Technology for Total Fitness Genesis 2000", 6 pages –copyright 1985.

Copy of brochure entitled "Technology for Total Fitness Genesis 3000", 6 pages –copyrighbt 1985.

Cover and selected pages from the Taiwan Buyer's Guide 1993.

Taiwan Sport Goods Buyer's Guide '95 cover page and pp. 1, 12–15, 18, 20, 21, 25–27, 32,109, 157–164, 173–181, 186–192, 197–210, 205, 226, 228, 232–239, 242, 250, 264, 265, 270–289, 292, 293, 295–297, 304, 314–317, 321–323, 330–337, 368–368.2, 485–544, 549–551.

Taiwan Sporting Goods Buyer's Guide –Mid–Year Supplement '92, cover page and pp. 88 and 95.

Taiwan Sporting Goods Buyer's Guide –Mid–Year Supplement '93, cover page and p. 145.

Taiwan Sporting Goods Buyer's Guide –Mid–Year Supplement '90, cover page and p. 58.

Taiwan Sporting Goods Buyer's Guide –Mid–Year Supplement '91 , cover page and pp. 69 and 71.

Taiwan Sporting Goods Buyer's Guide –Mid–Year Supplement '89, cover page and pp. 56, 61 and 77.

Taiwan Sporting Goods Buyer's Guide '92, cover page and pp. 219 and 221.

Taiwan Sporting Goods Buyer's Guide '94, cover page and pp. 210 and 211.

Taiwan Sporting Goods Buyer's Guide –Mid–Year Supplement '94, cover page and pp. 13, 97 and 113.

Formula Ventures 22115 Manual Treadmill Owner's Manual (know to be published in 1994).

FOLD-UP EXERCISE TREADMILL AND METHOD

This is a continuation of application Ser. No. 08/719,356 filed Sep. 24, 1996 now U.S. Pat. No. 5,833,577.

TECHNICAL FIELD

This invention relates to exercise treadmills for in-place walking, jogging, or running. More particularly, this invention relates to an improved exercise treadmill that can fold-up, thereby conserving space when the treadmill apparatus is not being used.

BACKGROUND OF THE INVENTION

Exercise treadmills are very popular for indoor aerobic exercise sessions. An exercise treadmill can be used regardless of the weather conditions outdoors. In addition, some people like to be distracted during the exercise session, thus, exercise treadmills are often desired to be positioned in a living area near a television set, perhaps setting a goal of working through a half-hour program.

Unfortunately, conventional treadmills require a relatively large area of living space. A conventional exercise treadmill is about five to six feet long and two to three feet wide, thus occupying ten or more square feet of living space. There has been a long-felt need for an improved exercise treadmill that is capable of being folded-up, whereby it is less obtrusive and requires much less living space. There has been also been a need for a treadmill that can be stored in a closet or other small space, brought out from time to time for an exercise session, and then returned to the closet out of the living area.

SUMMARY OF THE INVENTION

According to the invention, a fold-up exercise apparatus for in-place walking, jogging, or running exercise is provided. The fold-up exercise apparatus generally includes a base assembly having a leg structure for supporting the apparatus on a floor surface and a treadmill assembly. The treadmill assembly has a pivotal mounting to the base assembly, whereby the treadmill assembly can be pivotally moved on the base assembly between an unfolded position for an exercise session and a folded-up position such that the treadmill assembly is supported by the pivotal mounting to the base assembly to be substantially vertically supported for temporary storage.

According to yet another aspect of the invention, the apparatus further includes a means for raising and lowering the pivotal mounting of the treadmill assembly on the base assembly, whereby the incline of the treadmill assembly can be adjusted.

These and other aspects, features, and advantages of the present invention will be apparent to those skilled in the art upon reading the following detailed description of preferred embodiments according to the invention.

BRIEF DESCRIPTION OF THE DRAWINGS

The accompanying drawings are incorporated into and form a part of the specification to provide illustrative examples of the present invention. These drawings together with the description serve to explain the principles of the invention. The drawings are only for purposes of illustrating preferred and alternate embodiments of how the invention can be made and used and are not to be construed as limiting the invention to only the illustrated and described examples.

Various advantages and features of the present invention will be apparent from a consideration of the accompanying drawings in which.

DETAILED DESCRIPTION OF PREFERRED EMBODIMENTS

Figure 1:
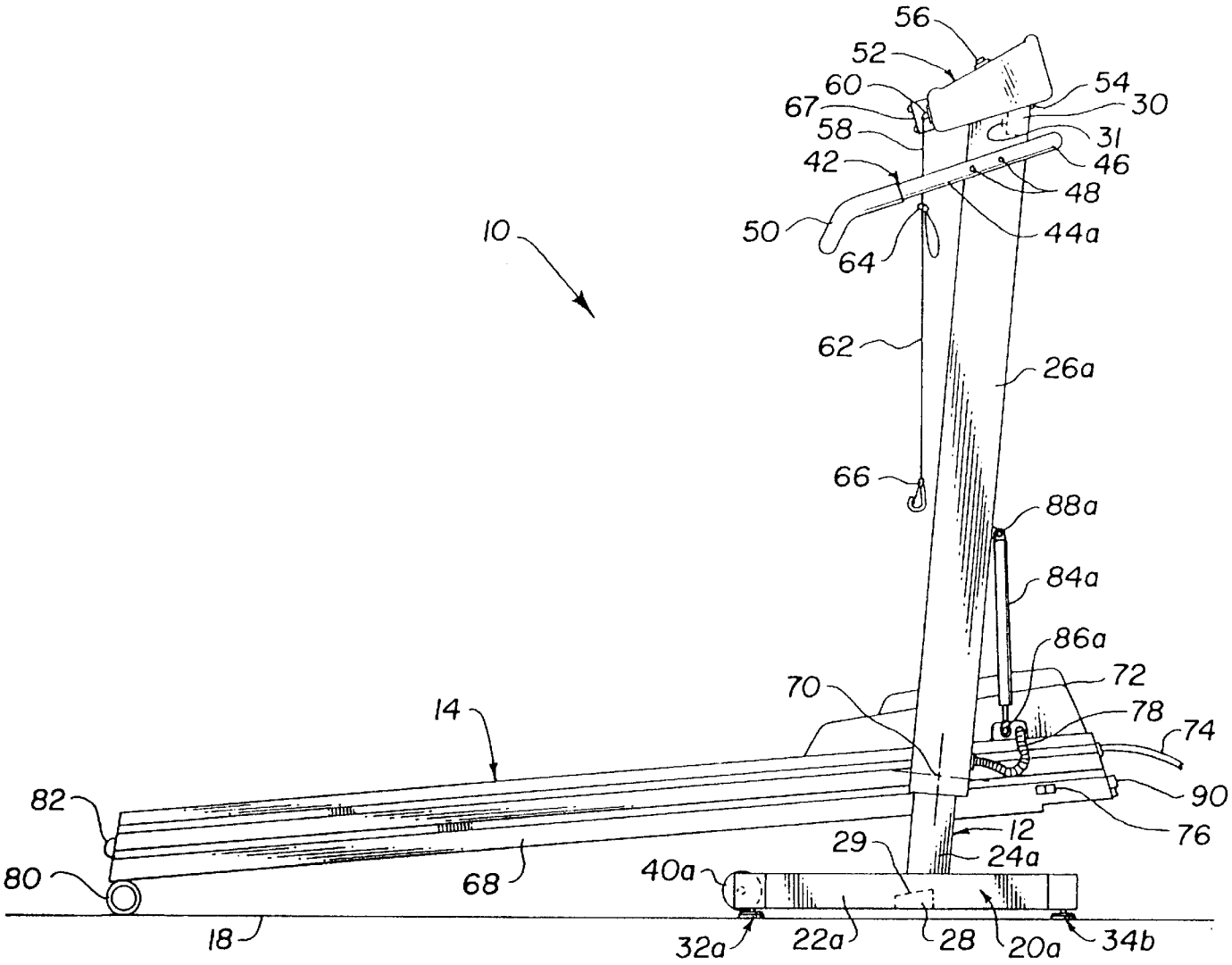
FIG. 1 is a side elevation view illustrating a fold-up treadmill apparatus according to a presently most preferred embodiment of the invention, having a base assembly and a treadmill assembly pivotally mounted to the base assembly, in which view the treadmill assembly of the apparatus is shown in the fully open or exercise position and is ready for a person to step onto the treadmill assembly of the apparatus for an exercise session.

The present invention will be described by referring to drawings of examples of how the invention can be made and used. Like reference characters are used throughout the several figures of the drawing to indicate like or corresponding parts.

Referring now to the drawings in more detail, FIG. 1 is a side elevation view illustrating a fold-up treadmill apparatus 10 according to a presently most preferred embodiment of the invention. As shown in FIG. 1, the treadmill apparatus 10 is in a fully un-folded or open position and is ready for a person to step onto the treadmill for an exercise session. As will be explained in detail, the fold-up treadmill apparatus 10 generally includes a base assembly 12 and a treadmill assembly 14 According to the invention and as will hereinafter be described in detail, the treadmill assembly 14 is pivotally mounted to the base assembly 12. The fold-up treadmill apparatus 10 is intended to be used on a substantially horizontal floor 18. As used herein, relative terms such as "right," and "left," and "forward," and "rearward" are from the perspective of a person standing on the treadmill assembly 14 facing toward the base assembly 12.

The base assembly 12 of the treadmill apparatus 10 includes right-side and left-side leg subassemblies, but only right-side leg subassembly 20*a* is visible in the side-elevation view of FIG. 1. Right-side subassembly 20*a* includes right-side horizontal leg 22*a* that supports a right-side upwardly extending leg 24*a*. Right-side upwardly extending leg 24*a* is welded or otherwise securely attached to the right-side horizontal leg 22*a*. Right-side upwardly extending leg 24*a* is preferably tilted slightly forward from where it is securely attached to the right-side horizontal leg 22*a*, for example, at an angle of about four degrees (4°) to a vertical plumb line. Right-side subassembly 20*a* further includes right-side extension arm 26*a*. As will hereinafter be explained in detail, right-side extension arm 26*a* is mounted to be raised and lowered on the right-side upwardly extending leg 24*a* of the subassembly 20*a*. According to the presently most preferred embodiment of the invention, the right-side extension arm 26*a* is mounted to telescope on the right-side upwardly extending leg 24*a*.

Figure 7:
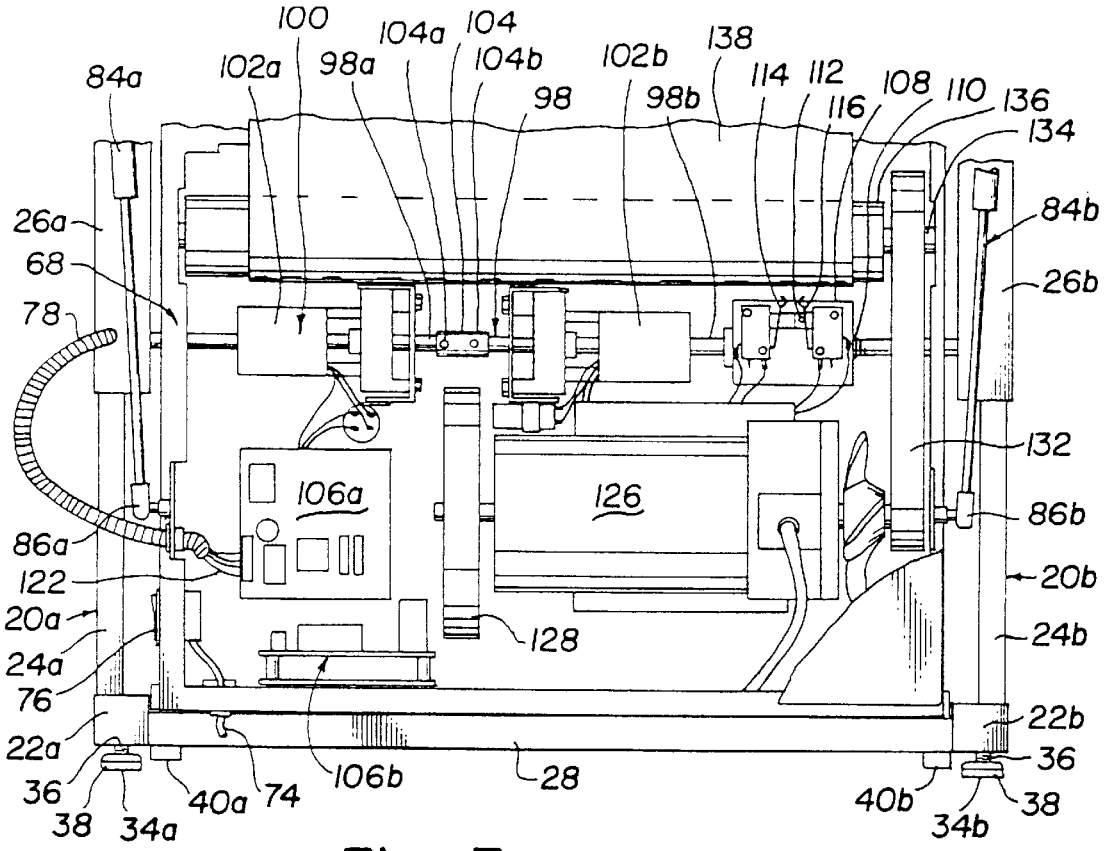
FIG. 7 is a rearward elevation view of the forward end of the treadmill assembly with the protective cover removed, further illustrating a presently most preferred embodiment of an incline motor and control subassembly for the gear rack subassembly.

Referring briefly ahead to FIG. 7 of the drawing, the left-side leg subassembly 20*b* is shown to be substantially identical to the right-side leg subassembly 20*a*. Left-side leg subassembly 20*b* includes left-side horizontal leg 22*b* that supports a left-side upwardly extending leg 24*b*. Left-side upwardly extending leg 24*b* is welded or otherwise securely attached to the left-side horizontal leg 22*b*. Left-side upwardly extending leg 24*b* is preferably tilted slightly forward from where it is securely attached to the left-side horizontal leg 22*b*, for example, at an angle of about four degrees (4°) to a vertical plumb line, which should be the same as the tilted angle for the right-side leg 22*a*, such that the right-side and left-side legs 22*a* and 22*b* are parallel. The left-side extension arm 26*b* is shown to be similarly mounted to be raised and lowered on the left-side upwardly extending leg 24*b*. According to the presently most preferred embodiment of the invention, the left-side extension arm 26*b* is mounted to slide or telescope on the left-side upwardly extending leg 24*b*.

As previously mentioned, the upwardly extending legs 24*a* and 24*b* of the base assembly 12 are preferably tilted slightly forward. As will hereinafter be described in detail, when the treadmill assembly 14 is moved into a folded-up position, it can be leaned forward against the base assembly 12, which provides additional stability against unintentionally falling from the un-folded position.

Continuing to refer to FIG. 7 of the drawing, the right-side horizontal leg 22*a* of the right-side leg subassembly 20*a* and the left-side leg horizontal leg 22*b* of the left-side leg subassembly 20*b* are rigidly interconnected by a leg cross-brace 28. Referring back to FIG. 1 of the drawing, leg cross-brace 28 is shown in phantom lines as part of the base assembly 12. The leg cross-brace 28 provides additional structural support to the base assembly 12. Furthermore, the leg cross-brace 28 has a upwardly sloped surface 29, which assists in retaining the treadmill assembly 14 in a vertical position when folded-up, as will hereinafter be explained in detail.

Continuing to refer to FIG. 1, the extension arms 26*a* and 26*b* of the base assembly 12 are preferably rigidly interconnected by an arm cross-brace 30, which is shown in phantom lines as part of the base assembly 12. The arm cross-brace 30 provides additional structural support to the base assembly 12, and assists in keeping the extension arms 26*a* and 26*b* moving in parallel alignment as the arms move on the upwardly extending legs 24*a* and 24*b*, respectively. Furthermore, arm cross-brace 30 has one or more stops 31 mounted thereto, which are adapted for supporting the treadmill assembly 14 in a vertical position when folded-up, as will hereinafter be explained in more detail.

As will hereinafter be described in detail, the forward end of the treadmill assembly 14 is pivotally mounted to the extension arms 26*a* and 26*b*. In FIG. 1 the telescoping extension arm 26*a* of the base assembly 12 is shown positioned such that the treadmill assembly 14 is in a relatively high inclined position relative to the horizontal floor level 18, at an incline angle of about ten degrees (10°). As will be explained in detail, the extension arm 26*a* can be raised higher or lowered relative to the position shown in FIG. 1 such that the incline of the pivotally mounted treadmill assembly 14 becomes greater or substantially parallel to the horizontal floor level 18. Thus, the treadmill assembly 14 preferably can be raised and lowered to any incline position between about zero degrees (0°) up to about fifteen degrees (15°) with respect to the horizontal floor level 18.

Continuing to refer to FIG. 1, the right-side horizontal leg 22*a* has a rearward leveler 32*a* and forward leveler 34*a*. Referring again to FIG. 7, the left-side horizontal leg 22*b* has a similar rearward leveler (not shown) and a similar forward leveler 34*b*. As best shown in FIG. 7, the forward levelers 34*a* and 34*b* each preferably have a threaded bolt portion 36 and a foot portion 38. The threaded bolt portion 36 is adapted to be received within a threaded bore (not shown) formed within the bottom of the forward end of each of the right-side and left-side horizontal legs 22*a* and 22*b*. Thus, the height of each foot portion 38 can be adjusted by screwing or unscrewing the leveler about threaded bolt portion 36. The foot portion 38 is preferably formed of a hard, smooth plastic, which is adapted to slide relatively easily across various types of flooring surfaces, such as tile or carpet. The rearward levelers, such as rearward leveler 32*a* shown in FIG. 1, are similarly constructed. By independently adjusting the height of each foot portion 38 of the levelers, the base assembly 12 can be made not to wobble on an uneven floor.

Referring to FIG. 1 and briefly ahead to FIG. 7, the base assembly 12 preferably also includes wheels 40*a* and 40*b* mounted to the rearward end of each of the horizontal legs 22*a* and 22*b*, respectively. These wheels 40*a* and 40*b* assist in moving the entire treadmill apparatus 10 to a desired storage location when the treadmill assembly 14 is in the folded-up position, as will hereinafter be described in detail.

Referring back to FIG. 1, the base assembly 12 also preferably includes a handle bar subassembly 42 mounted to the right-side and left-side arms. The handle bar subassembly 42 is preferably formed of a tubular rod that has been shaped into a generally U-shaped configuration having a pair of right-side and left-side handle arm portions, but only the right-side handle arm portion 44*a* is illustrated as extending rearward from the right-side extension arm 26*a* of the base assembly 12. The handle bar subassembly 42 has a cross-brace portion 46 extending laterally between the right-side and left-side extension arms 26*a* and 26*b* of the base assembly 12. The right-side handle arm portion 44*a* is preferably mounted to the right-side extension arm 26*a* of the base assembly 12 by one or more bolts 48. The left-side handle arm portion of the handle bar subassembly (not shown) is similarly mounted to the left-side extension arm 26*b* of the base assembly 12. Each of the handle arm portions is provided with a hand grip 50 as shown for the right-side handle arm portion in FIG. 1, whereby a person walking, jogging, or running on the treadmill assembly 10 can more securely grasp and grip the handle bar subassembly 42 of the base assembly 12 for assisting with balance.

The base assembly 12 further includes a console 52 mounted to the arm cross-brace 30 (shown in phantom lines) and across the upper ends of the right-side and left-side extension arms 26*a* and 26*b* of the base assembly 12. In the presently most preferred embodiment of the invention, the console 52 is preferably pivotally mounted, for example with conventional hinge 54. As will hereinafter be described in more detail with reference to FIG. 8, the console 52 has a START/STOP button 56 for controlling the raising and lowering of the treadmill assembly 14 on the base assembly 12 for folding and un-folding of the treadmill apparatus 10.

A safety tether 58 is most preferably provided with the console 52 of the base assembly 12. The safety tether 58 is for actuating a safety switch that for safety reasons should always be used by a person exercising on the treadmill apparatus 10. According to the presently most preferred embodiment The safety tether 58 includes a magnet head 60, a tether line 62, a length adjustment clip 64, and a clothing clip 66. The magnet head 60 engages and is retained on the console 52 by an opposite pole magnet mounted in the console 52. When the magnet head 60 is engaged, a small toggle kill switch in the console 52 is maintained in a depressed position, which maintains electrical power to the operational components of the treadmill apparatus 10. When a person is about to use the treadmill apparatus 10, he or she should fasten the clothing clip 66 of the safety tether 58 to an article of the clothing he or she is wearing. The length of the tether line 62 can be adjusted with the length adjustment clip 64 to take up any undesired slack in the tether line 62. When using the apparatus 10, if the person should accidentally fall or be unable to keep up with the treadmill speed and drop too far back on the treadmill assembly 14, the safety tether 58 will be pulled from the console 52, whereby the kill switch will stop the treadmill assembly 14. The treadmill assembly 14 should stop, depending on the speed of operation, within a two to three step "coast" anytime the magnet head 60 is pulled off the console 52.

The console also preferably has a small radio receiver 67, which can be used to receive the radio signals from a wireless heart rate monitor as will be described in more detail.

Continuing to refer to FIG. 1 of the drawing, the treadmill assembly 14 of the treadmill apparatus 10 includes a treadmill base 68 for supporting a conventional treadmill walking belt. As will hereinafter be explained in detail, preferably it is the forward end of the treadmill assembly 14 that is pivotally mounted about a pivot axis 70 to the lower end of right-side and left-side arms of the base assembly 12.

A suitable cover 72 is adapted to protect the motors and electronics of the apparatus 10, which will hereinafter be described in detail. The cover 72 is preferably formed of metal or molded plastic to protect the motors and other electronics from being stepped on or kicked by a person using the fold-up treadmill apparatus 10, and may have aesthetically pleasing contours. Further, the cover 72 protects users and others from possibly injuring themselves by putting their lingers or hands in the treadmill motor subassembly and incline motor and control subassembly.

A main power cord 74 is connected to the apparatus 10 through the cover 72. A main power switch 76 is preferably provided at the forward end of the treadmill assembly 14. A flexible electrical conduit sheath 78 is provided to connect control wires between the treadmill motor subassembly and the incline motor and control subassembly within the cover 72 through the right-side extension arm 26*a* and to the console 52 of the base assembly 12.

The rearward end of the treadmill assembly 14 is supported at the horizontal floor level 18 by one or more suitable foot supports 80. For example, in the presently most preferred embodiment of the invention, the foot support 80 is formed of a resilient rubber or plastic tubing, which partially deforms under the weight of a person standing on the treadmill assembly 14 and provides some shock absorption when a person is exercising on the apparatus 10. The rearward end of the treadmill base 68 is preferably provided with a lifting handle 82, which is convenient for grasping and lifting the rearward end of the treadmill assembly 14 upward for folding of the treadmill apparatus 10 as will hereinafter be described in more detail, The treadmill assembly 14 is also preferably provided with right-side and left side gas piston-cylinder units, but only the right-side gas piston-cylinder unit 84*a* is shown in FIG. 1. One end of the right-side gas piston-cylinder unit 84*a* is connected to the forward end of the treadmill base 68 at right-side first pivot connector 86*a,* and the other end of the gas piston-cylinder unit 84*a* is pivotally connected to the right-side extension arm 26*a* of the base assembly 12 at right-side second pivot connector 88*a.* Right-side piston-cylinder unit 84*a* is of conventional design having a pressurized gas contained within a cylinder portion that is compressed by a telescoping piston driven into the cylinder as the treadmill assembly 14 is pivotally rotated from an folded position to an unfolded position. Thus, the piston-cylinder unit 84*a* assists in counter-balancing the lowering, unfolding motion of the treadmill assembly 14. Referring briefly ahead to FIG. 7, left-side gas cylinder 84*b* is similarly constructed and attached to the forward end of the treadmill base 68 at left-side first pivot connector 86*b.* As will hereinafter be explained in detail, when a person uses the lifting handle 82 to raise or lower the treadmill assembly 14, the right-side gas piston-cylinder unit 84*a* and left-side gas piston-cylinder unit 84*b* assist in counter-balancing the weight of the treadmill assembly 14. The gas piston-cylinder units 84*a* and 84*b* prevent the treadmill assembly 14 from dropping uncontrollably about the pivot axis 70 in the event a person lets go of the lifting handle 82 of the treadmill assembly 14.

Further, continuing to refer to FIG. 1 of the drawing, one or more lower stops 90 are mounted to the forward end of the treadmill base 68. The lower stops 90 are preferably formed of a resilient material having a slightly tacky surface, such as rubber or certain types of plastic, which provides a non-slip engagement with the lower leg cross-brace 28 of the base assembly 12 when the treadmill assembly 10 is in the folded-up position, as will hereinafter be described in detail.

Figure 6:
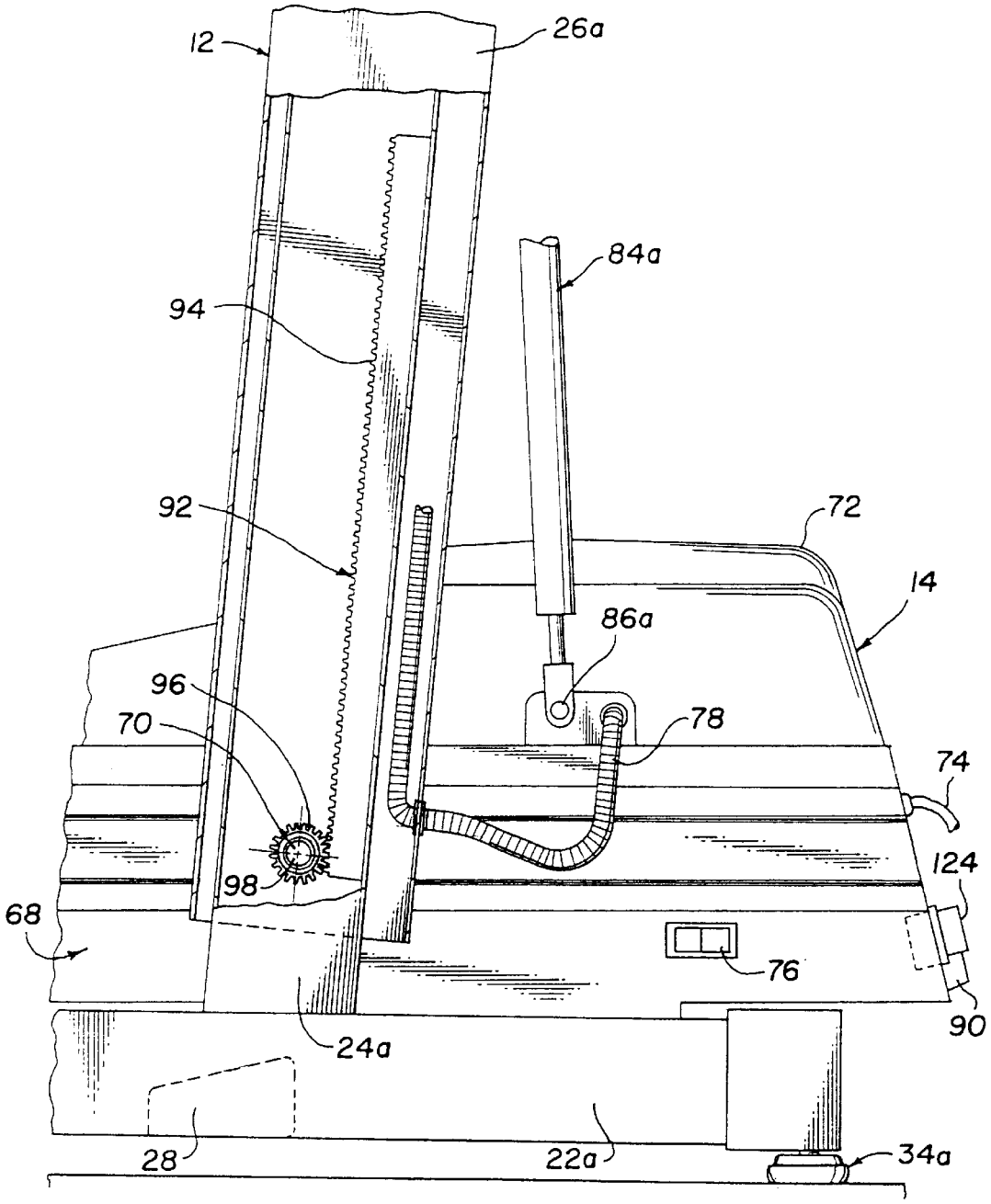
FIG. 6 is a side cross-section of the forward end portion of the treadmill assembly of the fold-up treadmill apparatus of FIG. 1, illustrating a presently most preferred embodiment of a gear rack subassembly for raising and lowering the telescoping legs of the base assembly, which has the forward end of the treadmill assembly pivotally mounted thereto.

Referring now to FIG. 6 of the drawing, according to the presently most preferred embodiment of the invention, a gear rack subassembly 92 is provided for raising and lowering the pivotal mounting of the treadmill assembly 14 on the base assembly. FIG. 6 shows a forward and lower portion of the base assembly 12, and the forward portion of the treadmill assembly 14.

Regarding the illustrated portion of the base assembly 12 in FIG. 6, the forward portion of right-side horizontal leg 22*a* and the right-side upwardly extending leg 24*a* of the base assembly 12 are shown. The side-elevation cross-section of the leg cross-brace 28 of the base assembly 12 is shown in phantom lines. The right-side forward leveler 34*a* is also shown as connected to the right-side horizontal leg 22*a*. Although not shown in this Figure, the left side of the apparatus 10 is similarly constructed. The lowermost portion of the right-side extension arm 26*a* is shown in partial cut-away section to illustrate that the extension arm 26*a* is a substantially hollow square tubular adapted to telescope over the right-side upwardly extending leg 24*a* of the base assembly 12. Although not shown in this Figure, the left side of the apparatus 10 is similarly constructed.

Regarding the illustrated portion of the treadmill assembly 14 in FIG. 6, the forward end of the treadmill base 68 is shown in a substantially horizontal position. According to the presently most preferred embodiment of the invention, the forward end of the treadmill assembly 14 is mounted to the base assembly 12 about a pivot axis 70 as will hereinafter be described in detail. The cover 72 for the treadmill motor and the incline motor and control subassembly (not shown in this Figure), the main power cord 74, the main power switch 76, the flexible electrical conduit sheath 78, the right-side gas piston-cylinder unit 84*a*, the right-side first pivot connector 86*a*, and lower stops 90 are also shown in FIG. 6.

Continuing to refer to FIG. 6, and in particular regarding the gear rack subassembly 92 for raising and lowering the forward end of the treadmill assembly 14 on the base assembly 12, the upwardly extending leg 24*a* of the base assembly 12 is shown in partial cut-away section to illustrate a gear rack 94 mounted within the leg 24*a*. A spur gear 96 is mounted on a drive shaft 98, which drive shaft 98 extends through an drive shaft aperture adjacent the lower end of the right-side extension arm 26*a*, such that the spur gear 96 is captured in engagement with a portion of the gear rack 94. In this presently most preferred embodiment of the invention, there is no inward-facing wall to the upwardly extending leg 24*a*, whereby the drive shaft 98 can move parallel to the gear rack 94 without obstruction. As will be explained in more detail in FIG. 7, the drive shaft 98 is connected to the incline motor assembly under cover 72 of the treadmill assembly 14.

According to this preferred embodiment, when the drive shaft 98 is rotated clockwise, the spur gear 96 rotates clockwise. The teeth of the spur gear 96 engage the corresponding gear teeth of the gear rack 94. Because the drive shaft 98 is captured through an aperture in the inward-facing wall of the right-side extension arm 26*a*, the arm 26*a* of the base assembly 12 is forced to travel upward as the clockwise rotation of the spur gear 96 engages the corresponding gear teeth of the gear rack 96. Similarly, when the drive shaft 98 is rotated counter-clockwise, the spur gear 96 rotates counter-clockwise. Because the drive shaft 98 is captured through an aperture in the inward-facing wall of the right-side extension arm 26*a*, the arm 26*a* of the base assembly 12 is forced to travel downward as the counter-clockwise rotation of the spur gear 96 engages the corresponding gear teeth of the gear rack 94. Although not shown in this Figure, the left side of the apparatus 10 is similarly constructed. Thus, a presently most preferred embodiment of a means for raising and lowering the treadmill assembly 14 on the base assembly 12 is provided.

It is important to note that the treadmill assembly 14 is mounted to the base assembly 12 by drive shaft 98, which extends through a drive shaft aperture adjacent the lowermost end of the right-side extension arm 26*a*. Thus, as the right-side and left-side extension arms 26*a* and 26*b* are raised and lowered, the treadmill assembly 14 is also raised and lowered. The pivot axis 70 of the mounting of the treadmill assembly 14 to the base assembly 12 is the same as the avis of the drive shaft 98. Thus, the gear rack 94, the spur gear 96, and drive shaft 98 must all be sufficiently strong to support the weight of both the treadmill assembly 14 and a person running on the treadmill assembly.

FIG. 7 is a rear elevation view of the forward end of the treadmill assembly 14 with the protective cover 72 not shown for clarity of the drawing. In FIG. 7, the treadmill assembly 14 is in the position illustrated in FIG. 5. Referring now to FIG. 7 of the drawing, a presently most preferred embodiment for an incline motor and control subassembly 100 for raising and lowering the treadmill assembly 14 is shown in detail.

The incline motor and control subassembly 100 preferably includes two incline electric motors 102*a* and 102*b* operatively connected to the drive shaft 98. Drive shaft 98 has a right-side shaft portion 98*a* extending through the right side wall of treadmill base 68 and through an aperture formed in right-side extension arm 26*a*, as previously described with respect to FIG. 6. Drive shaft 98 has a left-side shaft potion 98*b*, which is operatively connected to the incline motor 102 through a shaft connector 104. Shaft connector 104 can be, for example, a simple female-female shaft connector, having small set screws 104*a* and 104*b* for connecting to the right-side and left-side shaft portions 98*a* and 98*b*, respectively. Left-side shaft portion 98*b* of shaft 98 extends through the left side wall of treadmill base 68 and through an aperture formed in left-side extension arm 26*b*, similar to the structure previously described with respect to FIG. 6. Thus, the incline electric motors 102*a* and 102*b* of subassembly 100 are operatively connected to right-side and left-side shaft portions 98*a* and 98*b* of shaft 98 of the gear rack subassembly 92 previously described. It is to be understood, of course, that the number of incline motors is not critical to the practice of the invention, all that is requires is a motor or motors that have sufficient power to reliably raise and lower the treadmill assembly with the weight of a person thereon.

Continuing to refer to FIG. 7, the incline motor and control subassembly 100 further includes controller boards 106*a* and 106*b*, which selectively transform and provide power from the main power cord 74 and switch 76 to the incline electric motors 102*a* and 102*b* for driving the shaft 98, in response to user commands at the console 52 and other input signals for controlling the incline electric motor 102.

For example, computer controller boards 106*a* and 106*b* are preferably operatively connected to a limiter 108, which limits the rotation of the drive shaft 98 in either direction so that the forward end of the treadmill assembly 14 can be raised and lowered such that it is inclined anywhere in the range of about zero degrees (0°) to about fifteen degrees (15°) to the horizontal as previously described. The limiter 108 is designed to prevent the incline electric motor 102 from driving the shaft too far in either direction, which prevents the spur gear 96 from traveling off the gear rack 94 shown in FIG. 6. Continuing to refer to FIG. 7, the limiter 108 preferably includes a sheath 110 having a spiral groove formed in the surface thereof. The sheath 110 is mounted to the left-side shaft portion 98*b* of shaft 98 and is adapted to rotate with the shaft portion 98*b*. A partially resilient metal wire 112 is wound about the grooves of the spiral sheath 110. The wire 112 is positioned such that one end is upwardly extending between a first contact 114 and a second contact 116, and further such that when the treadmill assembly is lowered to a zero degree incline (substantially horizontal), the end of the wire 112 contacts the first contact 114, and when the shaft 98 is rotated such that the forward end of the treadmill assembly 14 is raised such that the incline is about 15 degrees, the end of the wire 112 contacts the second contact 116. When the wire 112 contacts the first contact 114, the limiter sends a signal to the controller boards 106*a* and 106*b,* which stops the incline electric motor 102 from further rotating the shaft 98 in that direction (which prevents the spur gear 96 from exceeding the lower range of the gear rack 94, as previously described with respect to FIG. 6.) Similarly, when the wire 112 contacts the second contact 114, the limiter 108 sends a signal to the controller boards 106*a* and 106*b,* which stops the incline electric motors from further rotating the shaft 98 in that direction (which prevents the spur gear 96 from exceeding the upper range of the gear rack 94, as previously described with respect to FIG. 6.)

The limiter 108 also preferably includes a slide potentiometer that measures the position of the wire 112 between the first contact 114 and second contact 116. The computer controller boards 106*a* and 106*b* are also preferably operatively connected to the slide potentiometer, thereby indicating the degree of elevation of the treadmill assembly 14 at any incline between zero degrees (0°) and fifteen degrees (15°) to the horizontal. It is to be understood, of course, that other means for measuring the degree of elevation of the treadmill assembly 14 can be employed. For example, a measuring wheel can be operatively connected with a pulley to the drive shaft 98. However, the slide potentiometer is the presently most preferred embodiment of the invention.

The computer controller boards 106*a* and 106*b* of the incline motor and controller subassembly 100 is also operatively connected to a central processing unit in the console 52 through a plurality of electrical control wires 122 passing through flexible electrical conduit sheath 78.

Figure 5:
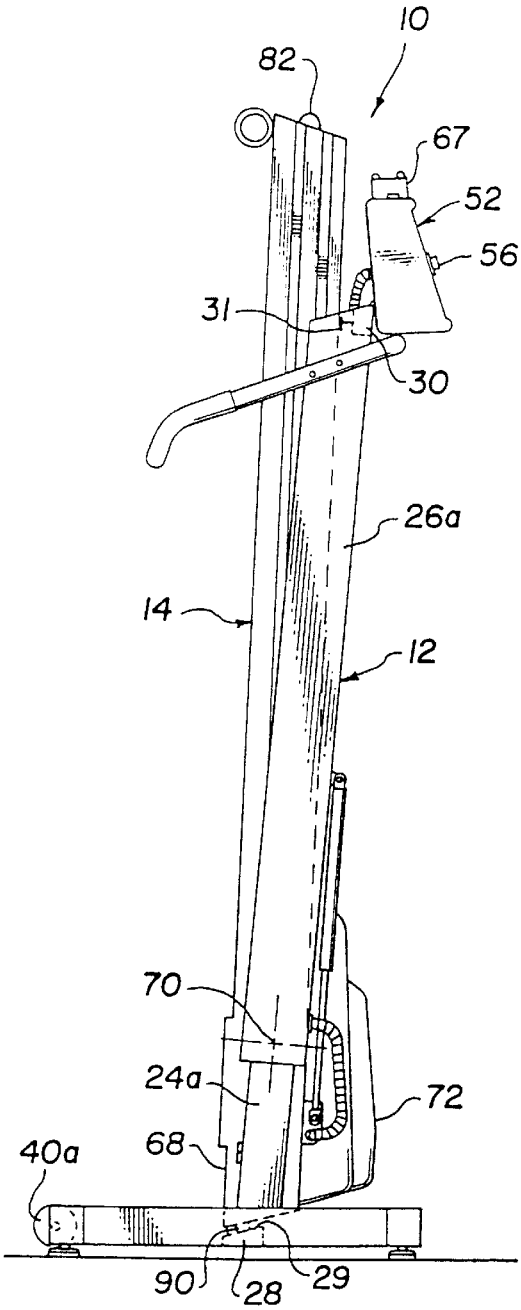
FIG. 5. is a side elevation view illustrating the fold-up treadmill apparatus of FIG. 1, wherein the treadmill assembly is lowered vertically downward such that the treadmill assembly securely engages the base assembly and locks the treadmill assembly in a vertical position against the base assembly, whereby the fold-up treadmill apparatus requires less floor space when not in use.

The computer controller boards 106*a* and 106*b* shown in FIG. 7 are preferably operatively connected to a stop toggle 124, which is shown in FIG. 6 to be positioned on the forwardmost end of the treadmill base 68 of the treadmill assembly 14. Continuing to refer to FIG. 6, the stop toggle 124 is depressed when the treadmill base 28 is lowered such that the stops 90 fully press against the upper surface of leg cross-brace 30 (shown in phantom lines), which occurs when the treadmill assembly 14 is moved into the fully folded-up position as shown in FIG. 5 and as hereinafter described in detail. Thus, the stop toggle indicates this fully folded-up position, which can be related to the rotational position of the shaft 98 as indicated by the slide potentiometer of the limiter 108. This position serves to provide a means to measure and periodically check the rotational position of the drive shaft 98, which can be further related to the degree of incline of the treadmill assembly 14 and related back to the console 52 through electrical control wires 122 passing through flexible electrical conduit sheath 78.

Continuing to refer to FIG. 7, the treadmill assembly 14 includes a treadmill motor 126 having a suitable flywheel 128 and cooling fan 130. The treadmill motor 126 is operatively connected through a treadmill drive transfer belt 132 to treadmill roller shaft 134 of forward treadmill roller 136, which drives treadmill walking belt 138. The treadmill motor 126 is operatively connected to the controller boards 106*a* and 106*b*.

Figure 8:
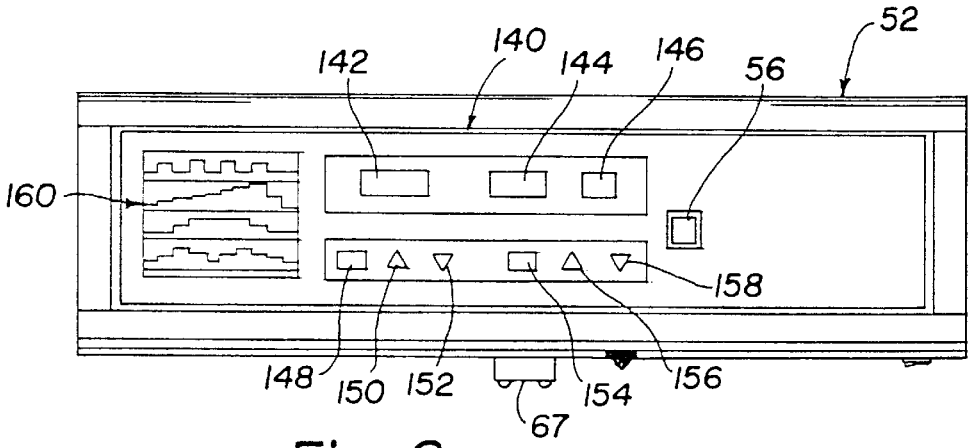
FIG. 8 is a top plan view illustrating one example of a suitable control panel for a fold-up treadmill apparatus according to the present invention.

Referring now to FIG. 8 of the drawing, the presently most preferred embodiment of the console face 140 of the console 52 is shown in detail. The console face 140 includes the previously described START/STOP button 56. The console face 140 further includes several light emitting diode displays, such as time/calories display 142, distance/incline display 144, and treadmill speed display 146. The console face 140 includes several control buttons, such as enter button 148, incline-up arrow button 150, incline-down arrow button 152, select button 154, speed-up button 156, speed-down button 158. Furthermore, the console face 140 includes graphic exercise profile displays 160 for graphically displaying several different pre-programmed treadmill exercise profiles, that vary the incline and the walking belt speed of the treadmill assembly 14 during the course of an exercise session.

A central processing unit (not shown) is preferably positioned in the console 52 and operatively connected between the various displays and control buttons of the console face 140 and to control wires 122 to the controller boards 106*a* and 106*b* as shown in FIG. 7. The central processing unit can be used to help control the fold-up treadmill apparatus 10, including the folding-up and unfolding of the treadmill assembly 14 on the base assembly 12 and other treadmill exercise profiles of the treadmill assembly 14.

As previously stated, the treadmill apparatus 10 is shown in FIG. 1 to be in an unfolded or open position, ready for a person to use for an exercise session. When an exercise session is complete and it is desired to reduce the floor space required by the apparatus 10, the following steps are performed.

Figure 2:
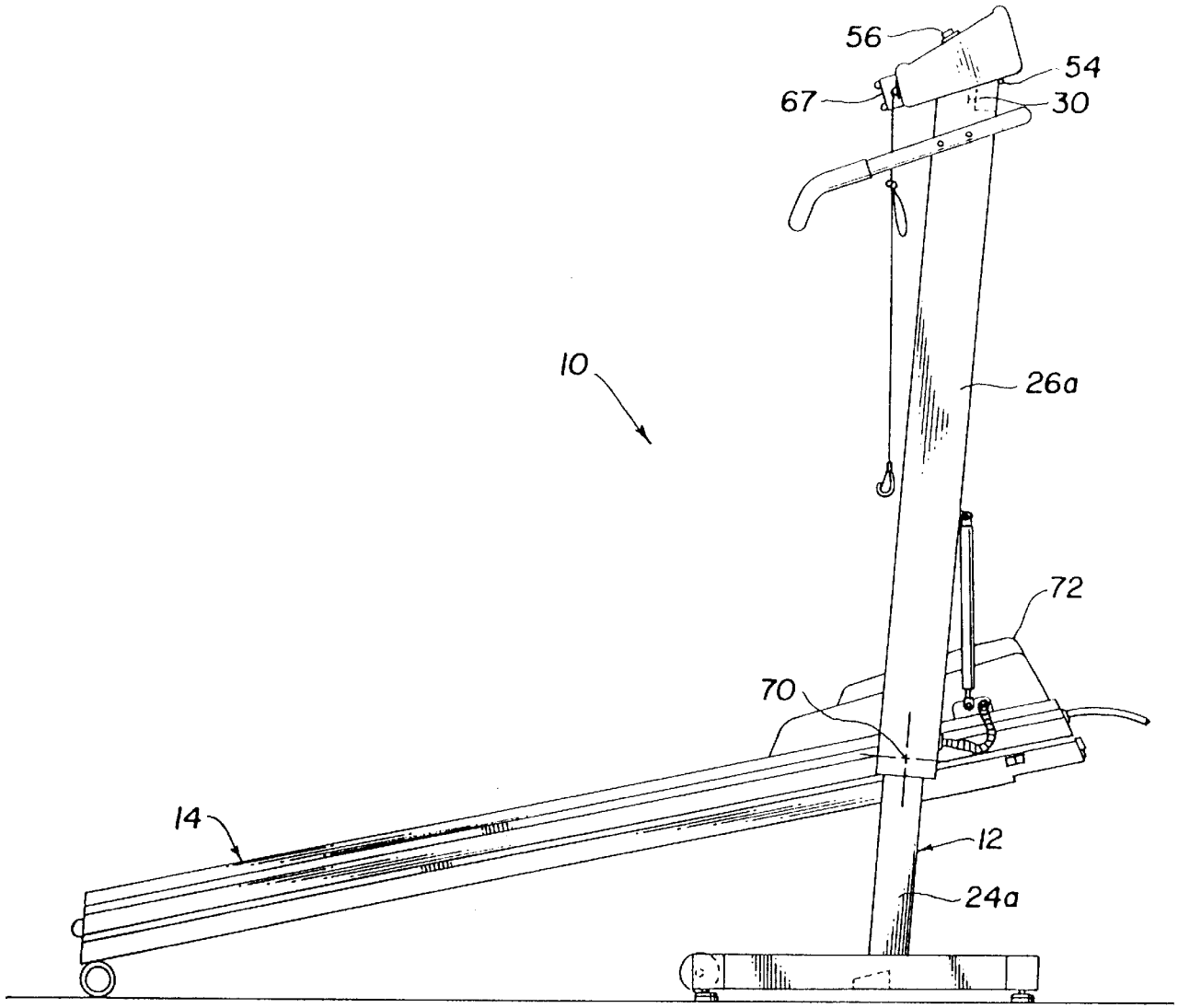
FIG. 2 is a side elevation view illustrating the fold-up treadmill apparatus of FIG. 1, wherein the upwardly extending arms of the base assembly are telescoped upward, whereby the forward end of the treadmill assembly is elevated.

First, the "START/STOP" button 56 is pressed, which sends a signal to the central processing unit in the console 52 to selectively activate the incline motor and control subassembly beneath the cover 72 to raise the forward end of the treadmill assembly 14 that is pivotally attached to the base assembly 12 to a steep incline position shown in FIG. 2. As will become more clear upon consideration of the next step of the folding-up procedure, the forward end of the treadmill assembly 14 should be raised a distance that is at least as high as the portion of the forward end of the treadmill assembly 14 that extends forward of the pivot axis 70. As shown in FIG. 2, the right-side extension arm 26*a* is raised to a relatively high position on the right-side upwardly extending leg 24*a* of the base assembly 12. (Similarly, the left-side extension arm is raised in parallel to a relatively high position on the left-side upwardly extending leg.)

Figure 3:
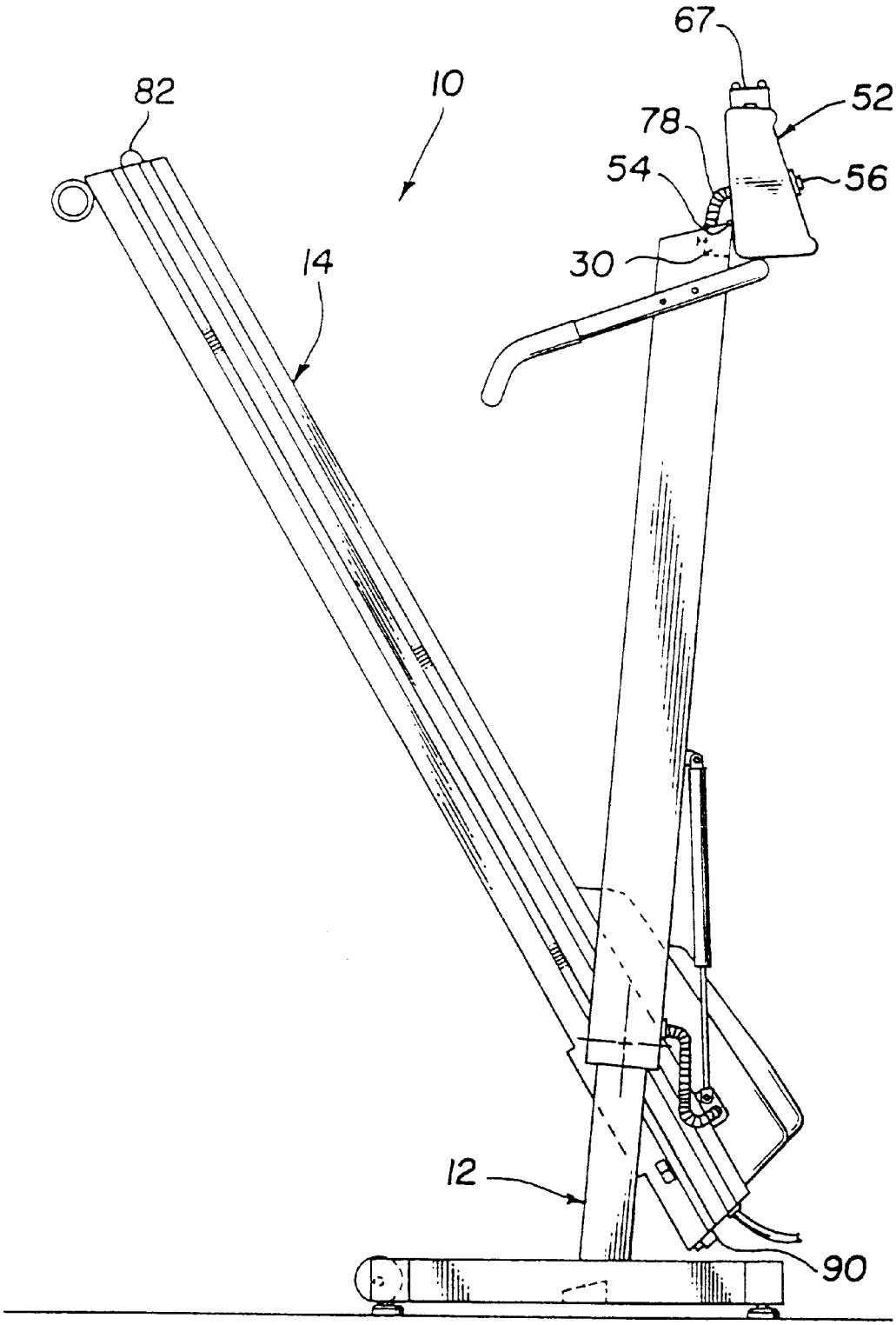
FIG. 3 is a side elevation view illustrating the fold-up treadmill apparatus of FIG. 1, wherein the rearward end of the treadmill assembly of the apparatus is shown in the process of being lifted upward and about the pivot axis adjacent the forward end of the treadmill assembly.

Second, the console 52 is pivotally rotated about hinge 54 on arm cross-brace 30 (shown in phantom lines) from the position shown in FIG. 2 into the position shown in FIG. 3.

Figure 4:
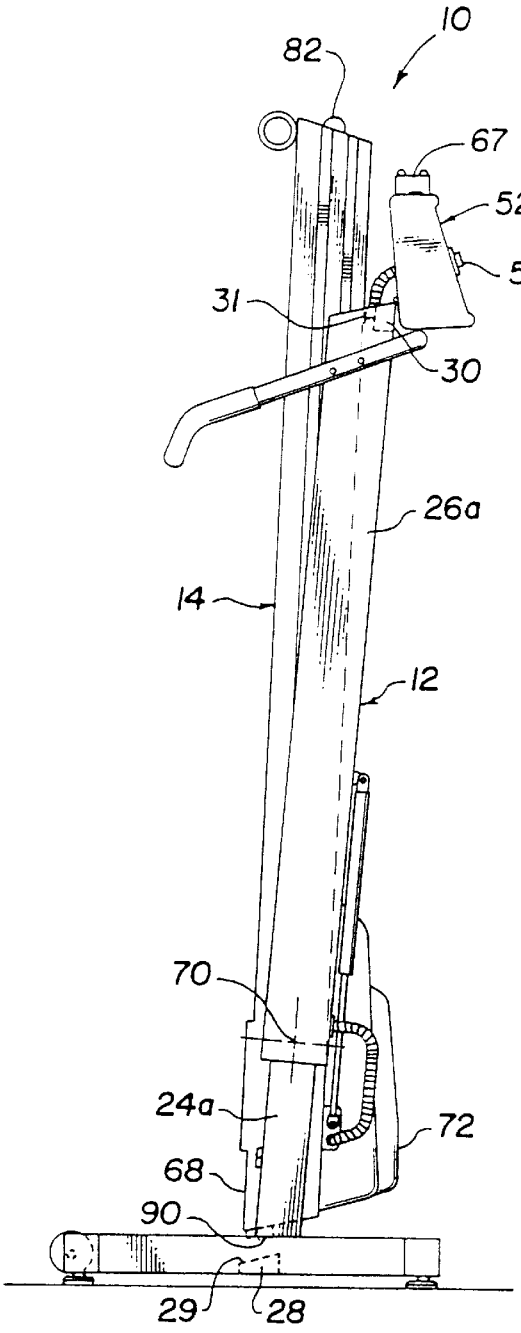
FIG. 4 is a side elevation view illustrating the fold-up treadmill apparatus of FIG. 1, wherein the treadmill assembly is shown fully lifted about the pivot axis adjacent the forward end of the treadmill assembly, such that the treadmill assembly is positioned substantially vertically adjacent the base assembly.

Third, the lifting handle 82 of the treadmill assembly 14 is used to lift the rearward end of the treadmill assembly 14 up and pivotally about the axis 70 of its mounting to the base assembly 12 as illustrated in FIG. 3. The lifting and pivoting motion is continued until the treadmill assembly 14 is moved from an unfolded or open position shown in FIG. 2 through a pivoting arm represented by the position shown in FIG. 3 and into a substantially vertical position as illustrated in FIG. 4, which is most preferably tilted slightly forward to lean against the stops 31 of upper arm cross-brace 30 (shown in phantom lines) of the base assembly 12. As shown in FIG. 4, the rearward end of the treadmill assembly is rotated about the pivot axis 70 until the rearward end is rotated above and to break over and forward of the pivot axis 70. Thus, the treadmill assembly 14 is prevented from pivoting any further in the folding direction by the upper end of the base assembly 12. Furthermore, because the upwardly extending leg 24*a* and extension arm 26*a* are tilted slightly forward, the rearward end of the treadmill assembly can lean against the base assembly in the illustrated break-over position, thereby assisting in retaining the treadmill assembly 14 in a substantially vertical position. A small bump or inadvertent tug on the apparatus 10 will not cause the treadmill assembly 14 to unexpectedly or undesirably unfold.

As apparent from FIG. 4, the console 52 is preferably pivotally mounted about hinge 54 so that the rearward end of the treadmill assembly 14 can be positioned substantially vertically and most preferably tilted slightly forward to lean against the stops 31 of upper arm cross-brace 30 (shown in phantom lines) of the base assembly 12. It is to be understood, however, that the pivotal mounting of the console 52 is not required to practice the invention; but in the particular form of the presently most preferred embodiment, such a hinge 54 is advantageous because it permits the treadmill assembly 14 to be tilted slightly forward than without moving the console 52.

The extension arms 26*a* and 26*b* of the base assembly 12 are raised sufficiently on upwardly extending legs 24*a* and 24*b*, respectively, that when the treadmill assembly 14 is rotated into the folded-up position shown in FIG. 4, there is sufficient height between the pivot axis 70 and the upper surface 29 of the lower leg cross-brace 28 (shown in phantom lines) that the lower stops 90 of the treadmill base 68 clear and are spaced above the leg cross-brace 28 of the base assembly 12.

Fourth, the START/STOP button 56 is pressed again, sends another signal to the central processing unit in the console 52 to selectively activate the incline motor and control subassembly beneath the cover 72 to lower the extension arms 26*a* and 26*b* of the base assembly 12 until the lower stops 90 (shown in phantom lines) on the treadmill base 68 of the treadmill assembly 14 engage the lower leg cross-brace 28 (shown in phantom lines) of the base assembly 12 as shown in FIG. 5. In the presently most preferred embodiment of the invention, the leg cross-brace 28 has a sloped upper surface 29 as shown, which is designed to engage the lower stops 90 and secure the treadmill assembly from accidentally unfolding. In this manner, the treadmill apparatus 10 is locked in a folded-up position for temporary storage.

When in the completely folded-up and locked position shown in FIG. 5, the treadmill apparatus 10 can be moved with the assistance of the wheels 40*a* and 40*b* on the base assembly 12. For safety reasons, it is important not to attempt to move the fold-up treadmill apparatus 10 without it being in the locked position shown in FIG. 5. Because the apparatus 10 is preferably built to withstand at least hard residential use or commercial use, it is to be expected that the treadmill apparatus 10 will be awkward and heavy to maneuver for many individuals. The inherent mass of the treadmill apparatus 10 makes it possible to fall over if the person moving it does not have adequate strength. To use the wheels 40 on the base assembly 12, the apparatus 10 is tilted rearward onto the wheels, which then allows the entire folded-up treadmill apparatus 10 to be carefully wheeled to a desired location, for example, out of a closed or away from a wall. If desired, the wheels 40 can be designed to move the treadmill apparatus 10 as if mounted to a dolly, but it is safest, however, not to unnecessarily move such a heavy apparatus 10, and the folding up feature is primarily intended to allow the apparatus 10 to remain in a desired location in a room but also to be folded up into a much less obtrusive position when not in use. It is expected that the capability of moving the apparatus 10 a relatively few feet, for example closer to a wall or into a closet space, should be adequate for most intended purposes.

To unlock and unfold the treadmill apparatus 10 from the folded and locked position shown in FIG. 5 back to the unfolded or open position shown in FIG. 1 for use in an exercise session, basically the same steps are followed in reverse.

First, the "START/STOP" button 56 is pressed, which selectively activates the incline motor and control subassembly beneath the cover 72 to raise the extension arms 26*a* and 26*b* of the base assembly 12 from the locked position shown in FIG. 5 to the position shown in FIG. 4.

Second, the lifting handle 82 of the treadmill assembly 14 is grasped to lower the rearward end of the treadmill assembly 14 down and pivotally about the pivot axis 70 of its mounting to the base assembly 12 as illustrated in FIG. 3. The lowering and pivoting motion is continued until the treadmill assembly 14 is moved into a steeply inclined position as illustrated in FIG. 2.

Third, the console 52 is pivotally rotated about hinge 54 from the position shown in FIG. 3 into the position shown in FIG. 2.

Fourth, the "START/STOP" button 56 is pressed again, which selectively lowers the extension arms 26*a* and 26*b* on the upwardly extending legs 24*a* and 24*b*, respectively, of the base assembly 12 until the treadmill assembly 14 is in a desired incline position such as that shown in FIG. 1.

According to the presently most preferred embodiment of the invention, it includes a heart rate monitor operatively connected to the control panel. For example, a wireless heart rate monitor can be used, which communicates via radio signals with the receiver 57. The purpose of the heart rate monitor is to help the person using the exercise treadmill 10 to maintain his or her heart rate within a desired range. For example, target heart rates based on general factors such as age and weight can be used to increase the benefits of the cardiovascular exercise without unduly stressing a persons system. In response to signals from the heart rate monitor, the computer controller of the apparatus 10 can be designed or programmed to automatically adjust the speed and/or the incline of the treadmill assembly 14 to increase or reduce the intensity of the exercise, thereby serving as a biofeedback device.

The embodiments shown and described above are only exemplary. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of parts within the principles of the invention to the full extent indicated by the broad and general meaning of the terms used in the attached claims.

The restrictive description and drawings of the specific examples above do not point out what an infringement of this patent would be, but are to provide at least one explanation of how to make and use the inventions. The limit of the inventions and the bounds of the patent protection are measured by and defined in the following claims.

Having described the invention, what is claimed is:

1. A powered, variable inclination fold-up treadmill apparatus for in-place walking, jogging or running exercise, the treadmill apparatus comprising:

a. a freestanding base adapted to engage a floor surface, an upright portion supported from the freestanding base, rollers mounted on the freestanding base positioned such that the treadmill apparatus is movable on the rollers when the freestanding base is tilted on the floor surface;

b. a treadmill assembly having a rigid frame and a front and a rear end, the treadmill assembly mounted for pivotal movement between an exercise orientation with the treadmill assembly supported between the freestanding base and the floor surface and a storage orientation with the treadmill assembly supported from the freestanding base in a position above the floor surface, an endless belt mounted on the rigid frame for movement, an exercise surface on the belt adapted to support a user when the treadmill assembly is in the exercise orientation;

c. an electric motor operably connected to the belt to move the belt in an endless path whereby the exercise surface of the belt can be used for exercise;

d. an elevator assembly supported from the freestanding base, the elevator assembly supporting the front end of the treadmill assembly above the floor, the elevator assembly comprising a pivot and a powered elevator, the pivot supporting the front end of the treadmill assembly to pivot about a horizontally extending treadmill assembly axis, the treadmill assembly being movable about the pivot between an exercise orientation with the rear end of the treadmill assembly supported by the floor surface and a storage orientation with the rear end of the treadmill assembly vertically elevated above the floor surface and supported from the freestanding base, the powered elevator operably connected to raise and lower the height of the pivot and in turn to raise and lower the height of the treadmill assembly axis to increase and decrease the inclination of the treadmill assembly and exercise surface without regard to whether or not the treadmill apparatus is in use; and e. a control assembly operably connected to the electric motor to control the electric motor thereby selectively changing the speed of movement of the belt, the control assembly operably connected to the powered elevator to control the operation of the powered elevator thereby selectively raising and lowering the pivot and in turn the treadmill assembly axis whereby the angle of inclination of the treadmill assembly and exercise surface can be increased and decreased by the user while the treadmill apparatus is in use.

2. A powered, variable inclination fold-up treadmill apparatus according to claim 1, wherein the elevator assembly comprises a gear rack meshing with a spur gear.

3. A powered, variable inclination fold-up treadmill apparatus according to claim 1, wherein the powered elevator comprises an incline motor mounted to move with the treadmill assembly as the inclination of the treadmill assembly is increased and decreased by the user.

4. A powered, variable inclination fold-up treadmill apparatus according to claim 1, wherein the control assembly comprises a control monitor mounted on an upright portion where it can be viewed and operated by the user during use of the treadmill apparatus.

5. A powered, variable inclination fold-up treadmill apparatus according to claim 4, wherein the control monitor is pivotally mounted to an upright portion to pivot between a substantially horizontal orientation and a substantially vertical orientation.

6. A powered, variable inclination fold-up treadmill apparatus according to claim 1, wherein the upright portion comprises two spaced apart substantially parallel upright members.

7. A powered, variable inclination fold-up treadmill apparatus according to claim 3, further comprising a position sensor assembly having at least one position sensor located in the path of movement of the treadmill assembly when the inclination of the treadmill assembly is increased and decreased, the position sensor assembly operably connected to the incline motor to disengage the incline motor when at least one of the position sensors is activated by the movement of the treadmill assembly.

8. A powered, variable inclination fold-up treadmill apparatus according to claim 1, further comprising means for preventing pivoting of the treadmill assembly about the treadmill assembly axis between the exercise orientation and the storage orientation when the treadmill assembly is in the storage orientation thereby preventing accidental pivoting of the treadmill assembly.

9. A powered, variable inclination fold-up treadmill apparatus according to claim 8, wherein the means for preventing pivoting of the treadmill assembly about the treadmill assembly axis between the exercise orientation and the storage orientation comprises providing a portion of the freestanding base positioned to contact the treadmill assembly when the treadmill assembly is in the storage orientation and is lowered to a stowed position.

10. A powered, variable inclination fold-up treadmill apparatus according to claim 1, wherein the freestanding base has a front side and a back side, the back side in closer proximity to the rear end of the treadmill assembly when the treadmill assembly is in the exercise orientation, the rollers mounted to the freestanding base on the back side of the freestanding base such that the treadmill apparatus is movable on the rollers when the treadmill apparatus is tilted on the floor surface.

11. A powered, variable inclination fold-up treadmill apparatus according to claim 10, wherein the rear end of the treadmill assembly comprises a tilt handle for tilting the treadmill apparatus on the floor surface toward the back side of the freestanding base when the treadmill assembly is in the storage orientation such that the treadmill apparatus is movable on the rollers.

12. A powered, variable inclination fold-up treadmill apparatus according to claim 1, wherein the treadmill assembly further comprises at least one resilient foot support connected to the rear end of the treadmill assembly, the at least one resilient foot support supporting the rear end of the treadmill assembly when the treadmill assembly is in the exercise orientation, thereby reducing stresses on the pivot due to use of the treadmill apparatus by a user.

13. A powered, variable inclination fold-up treadmill apparatus for in-place walking, jogging or running exercise, the treadmill apparatus comprising:

a. a freestanding base adapted to engage the floor surface, an upright portion supported from the freestanding base, rollers mounted on the freestanding base positioned such that the treadmill apparatus is movable on the rollers when the freestanding base is tilted on the floor surface;

b. a treadmill assembly having a rigid frame, the treadmill assembly mounted for pivotal movement between an exercise orientation with the treadmill assembly supported between the freestanding base and the floor surface and a storage orientation with the treadmill assembly supported from the freestanding base in a position above the floor surface, and having an endless belt mounted on the rigid frame for movement, an exercise surface on the belt adapted to support a user when the treadmill assembly is in the exercise orientation;

c. an electric motor associated with the belt to move the belt in an endless path whereby the exercise surface of the belt can be used for exercise;

d. a powered elevator means for supporting a front end of the treadmill assembly from the freestanding base and for changing the height that the front end of the treadmill assembly is supported above the floor, the front end of the treadmill assembly being connected to the elevator means to pivot about a horizontally extending treadmill assembly axis, the treadmill assembly being movable about the axis between an exercise orientation with the rear end of the treadmill assembly supported from the floor surface and a storage orientation with the rear end of the treadmill assembly vertically elevated above the floor surface, whereby the powered elevator means can raise and lower the height of the treadmill assembly axis to increase and decrease the inclination of the treadmill assembly and exercise surface without regard to whether or not the treadmill is in use; and e. a control assembly operably connected to the electric motor to control the electric motor thereby selectively changing the speed of movement of the belt, the control assembly operably connected to the powered elevator means to control the operation of the powered elevator means, selectively raising and lowering the treadmill assembly axis and thereby the angle of inclination of the treadmill assembly and exercise surface while the treadmill apparatus is in use.

14. A powered, variable inclination fold-up treadmill apparatus according to claim 13, wherein the powered elevator means comprises a gear rack meshing with a spur gear.

15. A powered, variable inclination fold-up treadmill apparatus according to claim 12, wherein the powered elevator means comprises an incline motor mounted to move with the treadmill assembly as the inclination of the treadmill assembly is increased and decreased by the user.

16. A powered, variable inclination fold-up treadmill apparatus according to claim 12, wherein the control assembly comprises a control monitor mounted on an upright portion where it can be viewed and operated by the user during use of the treadmill apparatus.

17. A powered, variable inclination fold-up treadmill apparatus according to claim 15, wherein the control monitor is pivotally mounted to an upright portion to pivot between a substantially horizontal orientation and a substantially vertical orientation.

18. A powered, variable inclination fold-up treadmill apparatus according to claim 12, wherein the upright portion comprises two spaced apart substantially parallel upright members.

19. A powered, variable inclination fold-up treadmill apparatus according to claim 14, further comprising a position sensor assembly having at least one position sensor located in the path of movement of the treadmill assembly when the inclination of the treadmill assembly is increased and decreased, the position sensor assembly operably connected to the incline motor to disengage the incline motor when at least one of the position sensors is activated by the movement of the treadmill assembly.

20. A powered, variable inclination fold-up treadmill apparatus according to claim 12, further comprising means for preventing pivoting of the treadmill assembly about the treadmill assembly axis between the exercise orientation and the storage orientation when the treadmill assembly is in the storage orientation thereby preventing accidental pivoting of the treadmill assembly.

21. A powered, variable inclination fold-up treadmill apparatus according to claim 19, wherein the means for preventing pivoting of the treadmill assembly about the treadmill assembly axis between the exercise orientation and the storage orientation comprises providing a portion of the freestanding base positioned to contact the treadmill assembly when the treadmill assembly is in the storage orientation and is lowered to a stowed position.

22. A powered, variable inclination fold-up treadmill apparatus according to claim 12, wherein the freestanding base has a front side and a back side, the back side in closer proximity to the rear end of the treadmill assembly when the treadmill assembly is in the exercise orientation, the rollers mounted to the freestanding base on the back side of the freestanding base such that the treadmill apparatus is movable on the rollers when the treadmill apparatus is tilted on the floor surface.

23. A powered, variable inclination fold-up treadmill apparatus according to claim 21, wherein the rear end of the treadmill assembly comprises a tilt handle for tilting the treadmill apparatus on the floor surface toward the back side of the freestanding base when the treadmill assembly is in the storage orientation such that the treadmill apparatus is movable on the rollers.

24. A powered, variable inclination fold-up treadmill apparatus according to claim 12, wherein the treadmill assembly further comprises at least one resilient foot support connected to the rear end of the treadmill assembly, the at least one resilient foot support supporting the rear end of the treadmill assembly when the treadmill assembly is in the exercise orientation thereby reducing stresses on the pivot due to use of the treadmill apparatus by a user.

25. A method of variably inclining a powered fold-up treadmill apparatus for in-place walking, jogging or running exercise, the treadmill apparatus of the type having a freestanding base adapted to engage a floor surface, an upright portion supported from the freestanding base, the method comprising the steps of:

pivoting a treadmill assembly about a horizontally extending treadmill assembly axis between an exercise orientation with a rear end of the treadmill assembly supported by the floor surface and a storage orientation with the rear end of the treadmill assembly vertically elevated above the floor surface and supported from the freestanding base, the treadmill assembly having a rigid frame, rollers mounted on the freestanding base positioned such that the treadmill apparatus is movable on the rollers when the freestanding base is tilted on the floor surface;

selectively powering an endless belt with an electric motor, the belt mounted on the rigid frame to move in an endless path whereby an exercise surface on the belt can be used for exercise, the endless belt operably connected to a control assembly for controlling the speed of movement of the belt; and selectively varying the height of the treadmill assembly axis with respect to the freestanding base to increase and decrease the inclination of the treadmill assembly and the exercise surface without regard to whether or not the treadmill apparatus is in use, the height of the treadmill assembly axis raised and lowered by an elevator assembly having a pivot and a powered elevator, the pivot supporting the treadmill assembly to pivot about the treadmill assembly axis, the powered elevator operably connected to vary the height of the treadmill assembly axis with respect to the base, the powered elevator operably connected to the control assembly for controlling the variance of the height of the treadmill assembly axis.

26. The method of claim 24, wherein the elevator assembly comprises a gear rack meshing with a spur gear.

27. The method of claim 24, wherein the powered elevator comprises an incline motor mounted to move with the treadmill assembly as the inclination of the treadmill assembly is increased and decreased by the user.

28. The method of claim 24, wherein the control assembly comprises a control monitor mounted on an upright portion where it can be viewed and operated by the user during use of the treadmill apparatus.

29. The method of claim 27, further comprising the step of pivoting; the control monitor about a horizontally extending control monitor axis between a substantially horizontal position and a substantially vertical position.

30. The method of claim 28, wherein an upright portion comprises two spaced apart substantially parallel upright members.

31. The method of claim 24, further comprising a position sensor assembly having at least one position sensor located in the path of movement of the treadmill assembly when the inclination of the treadmill assembly is increased and decreased, the position sensor assembly operably connected to the incline motor to disengage the incline motor when at least one of the position sensors is activated by the movement of the treadmill assembly.

32. The method of claim 30, further comprising the step of preventing the pivoting of the treadmill assembly about the treadmill assembly axis between the exercise orientation and the storage orientation when the treadmill assembly is in the storage orientation thereby preventing accidental pivoting of the treadmill assembly.

33. The method of claim 31, wherein the freestanding base comprises a portion positioned to contact the treadmill assembly when the treadmill assembly is in the storage orientation and is lowered to a stowed position.

34. The method of claim 24, wherein the freestanding base has a front side and a back side, the back side in closer proximity to the rear end of the treadmill assembly when the treadmill assembly is in the exercise orientation, the rollers mounted to the freestanding base on the back side of the freestanding base such that the treadmill apparatus is movable on the rollers when the treadmill apparatus is tilted on the floor surface.

35. The method of claim 33, wherein the rear end of the treadmill assembly comprises a tilt handle for tilting the treadmill apparatus on the floor surface toward the back side of the freestanding base when the treadmill assembly is in the storage orientation such that the treadmill apparatus is movable on the rollers.

36. The method of claim 24, wherein the treadmill assembly further comprises at least one resilient foot support connected to the read end of the treadmill assembly, the at least one resilient foot support supporting the rear end of the treadmill assembly when the treadmill assembly is in the exercise orientation thereby reducing stresses on the pivot due to use of the treadmill apparatus by a user.

* * * * *

UNITED STATES PATENT AND TRADEMARK OFFICE

CERTIFICATE OF CORRECTION

PATENT NO. : 6,110,076
DATED : August 29, 2000
INVENTOR(S) : C. Rodger Hurt

It is certified that error appears in the above-identified patent and that said Letters Patent is hereby corrected as shown below:

Column 15,
Line 32, "12" should be -- 13 --;
Line 37, "12" should be -- 13 --;
Line 42, "15" should be -- 16 --;
Line 47, "12" should be -- 13 --;
Line 51, "14" should be -- 15 --;
Line 60, "12" should be -- 13 --;
Line 67, "19" should be -- 20 --;

Column 16,
Line 8, "12" should be -- 13 --;
Line 17, "21" should be -- 22 --;
Line 24, "12" should be -- 13 --;

Column 17,
Line 1, "24" should be -- 25 --;
Line 3, "24" should be -- 25 --;
Line 7, "24" should be -- 25 --;
Line 11, "27" should be -- 28 --;
Line 12, after 'pivoting" delete ";";
Line 15, "28" should be -- 29 --;
Line 18, "24" should be -- 25 --;
Line 26, "30" should be -- 31 --;

UNITED STATES PATENT AND TRADEMARK OFFICE

CERTIFICATE OF CORRECTION

PATENT NO. : 6,110,076
DATED : August 29, 2000
INVENTOR(S) : C. Rodger Hurt

It is certified that error appears in the above-identified patent and that said Letters Patent is hereby corrected as shown below:

Column 18,
Line 3, "31" should be -- 32 --;
Line 7, "24" should be -- 25 --;
Line 15, "33" should be -- 34 --;
Line 21, "24" should be -- 25 --.

Signed and Sealed this

Seventh Day of August, 2001

Nicholas P. Godici

*Attest:*

*Attesting Officer*

NICHOLAS P. GODICI
*Acting Director of the United States Patent and Trademark Office*